US007118078B2

(12) United States Patent
Vukas

(10) Patent No.: US 7,118,078 B2
(45) Date of Patent: Oct. 10, 2006

(54) PAINTBRUSH SUPPORT APPARATUS AND METHOD

(76) Inventor: Rudy Vukas, 1487 8th Ave., Freedom, PA (US) 15042

( * ) Notice: Subject to any disclaimer, the term of this patent is extended or adjusted under 35 U.S.C. 154(b) by 0 days.

(21) Appl. No.: 10/364,845

(22) Filed: Feb. 13, 2003

(65) Prior Publication Data

US 2004/0159752 A1 Aug. 19, 2004

(51) Int. Cl.
*A46B 17/02* (2006.01)

(52) U.S. Cl. ..... 248/110

(58) Field of Classification Search ..... 248/110, 248/213.2, 111, 112, 113, 176.1, 176.3, 309.1, 248/125.1, 125.3, 149; 15/257.05, 257.01, 15/257.07, 246; 222/405; 401/121, 123, 401/127, 291

See application file for complete search history.

(56) References Cited

U.S. PATENT DOCUMENTS 557,014 A * 3/1896 Osgood ..... 401/127
731,289 A * 6/1903 Domagola ..... 220/697
1,065,823 A * 6/1913 Matthews ..... 222/205
1,092,428 A * 4/1914 Browning ..... 401/127
2,196,614 A 4/1940 Spitz
2,369,335 A * 2/1945 Burman ..... 15/257.05
2,566,650 A * 9/1951 Anderson ..... 211/65
2,568,814 A * 9/1951 Marcellus ..... 222/520
2,601,940 A * 7/1952 Marcellus ..... 222/205
2,803,374 A * 8/1957 Cash ..... 220/696
2,939,162 A * 6/1960 Kravitt ..... 15/257.05
3,221,359 A * 12/1965 Moroni et al. ..... 401/130
3,641,615 A * 2/1972 Peasley ..... 15/257.05
4,020,523 A * 5/1977 Brown ..... 15/257.05
4,721,225 A * 1/1988 Sobel ..... 220/736
4,752,147 A * 6/1988 Persi ..... 401/126
4,831,681 A * 5/1989 Puder ..... 15/257.05
4,948,078 A * 8/1990 Dumenigo ..... 248/176.1
4,949,864 A 8/1990 LaKier
D364,949 S * 12/1995 Birch ..... D32/54
6,616,110 B1 * 9/2003 McIntee ..... 248/213.2
6,655,557 B1 * 12/2003 Rousselet et al. ..... 222/391

* cited by examiner

*Primary Examiner*—A. Joseph Wujciak, III
(74) *Attorney, Agent, or Firm*—Harold A. Williamson

(57) ABSTRACT

A paintbrush support apparatus for use in a container and a method of controlling the depth bristles of the brush may be dipped into paint in the container, as the paint level falls in the container. The brush support apparatus includes a rotatable disk that is adapted to accommodate the bristles of a brush resting thereon. The disk is physically configured to have an annular, helical thread configuration that cooperates with a mating helical thread structure that is adapted for inclusion in the container. Rotation of the disk causes the disk to move to varying levels in the container from a top of the mating helical thread structure to a bottom of the mating thread structure adjacent the bottom of the container.

11 Claims, 7 Drawing Sheets

PAINTBRUSH SUPPORT APPARATUS AND METHOD

FIELD OF THE INVENTION

Paintbrush support apparatus and method for use in and with a paint container.

BACKGROUND OF THE INVENTION

In today's do-it-yourself culture, it would be difficult to find a do-it-yourselfer who has not at some time taken a paintbrush in hand to paint or repaint some aspect of his dwelling or its contents. When the job is bigger than a simple touch-up task, paint is often purchased by the quart or the gallon. It is quite common for the painter to simply open the container, make sure the paint is well mixed and then dip the bristles of the paintbrush into the paint, moistening the tips of the bristles with paint. Once the lower end of the bristles of the brush is moistened with paint to a predetermined height, the paint is transferred from the brush bristles to a surface to be painted. Then the brush is re-dipped in the paint. Care is required so as not to re-dip the bristles into the paint to a higher level on the bristles than on the initial dip. Individuals who paint infrequently may not be fully aware that the paintbrush bristles in a region near the end of the bristles are designed to provide a wicking action of the paint up into the bristles to provide optimum delivery of paint from container-to brush-to surface-to-be-painted. When the bristles of the brush are inserted in the paint such that the designed paint carrying capacity of the bristles is exceeded, there is a great tendency for paint to drip from the brush's bristles. As the painting progresses, it is common for a painter to find himself discouraged by what seems to be slow progress. In order to speed up the painting, it is common to dip the bristles of the brush deeper into the paint only to discover that the moment the brush's bristles have been dipped past a point where a metal band secures the bristles to the handle of the brush, there is suddenly too much paint on the brush. When the painter is applying paint to a surface above his head and he attempts to carry too much paint on the brush, the result is often paint running back over the paintbrush handle and onto the fingers of his hand holding the brush. This over-dipping is most often brought on by the painter's zeal to get on with the task of getting the paint onto a surface. Unwittingly the painter has sabotaged the useful life of his paintbrush, for the moment the paintbrush is dipped in the paint to a point above where the bristles are secured to the brush by the metal band, the bristles that are encased in the metal band become moistened with paint and quickly wick paint from the bristles up into the metal band where the bristles are secured to the handle. To their dismay, almost all do-it-yourself painters have had this experience, when the painting is finished and the brush has been cleaned up for later use, a close look at the brush reveals that paint is entrapped between bristles beneath the metal band that secures the bristles to the brush handle. Diligent applications of a wire brush to the bristles to remove old paint from the brush bristles adjacent the metal band appear to be successful. At a later date when the paintbrush is used again, the user is dismayed to discover that bristles of the brush adjacent the metal, which appeared soft and flexible at the end of the brush cleaning process, are now quite stiff. The delivery of paint is nowhere as easy as it was during the first use of the brush. Most people will agree painting is a pleasant experience when they have in hand a high quality, expensive paintbrush, having top quality bristles that are shaped to deliver optimum amounts of paint to a surface to be painted. It does not take many painting experiences of the type described above for a budget minded do-it-yourselfer to skip buying an expensive brush that he will probably ruin, and buy the cheapest brush. This cheap brush will have inferior paint carrying and application performance, but it can be thrown away when the task is done. It is common for experienced painters who paint all day long to discover that as the day progresses, the accuracy of their brush dipping skill tends to falter as they move up and down ladders and the paint level in the container changes as paint is removed.

A paintbrush holder which allows a paintbrush to be incrementally lowered into a paint can as paint is removed from the can by means of the brush is shown and described in U.S. Pat. No. 4,949,864 ('864) to Earl I. Lakier issued Aug. 21, 1990. The '864 provides a plate structure that rests in a pivotal manner on a top edge of the can, whereas another end of the plate is adjustably secured to an opposing edge of the can. A paintbrush may be placed upon the plate structure and as the plate is adjustably pivoted the plate moves down into paint in the container so as to adjust the depth to which a brush's bristles may be adjustably lowered into the paint.

An inherent drawback in the paintbrush holder of the '864 resides in the requirement that the brush holder be removed completely from the paint can and thoroughly washed between uses. A flexible, ratchet-type tie, secured to the adjustable end of the plate and the edge of the can, provides an inherent mating structure that may easily become fouled by paint that drips from a paintbrush as the brush is removed from the brush holder and excess paint is wiped from the brush across a lip adjacent the ratchet tie.

By its very design, the paintbrush support apparatus of the '864 patent requires that between uses the brush rests on its side against the support plate. During these moments between uses, paint inadvertently dripped or wiped from the brushes onto the surface of the support plate comes into direct contact with the brush bristles adjacent the metal band, which allows paint to be drawn into the bristles under the metal band. The long-term effect of this inadvertent wicking of paint drawn into bristles under the metal band eventually reduces the useful life of the paintbrush.

The subject invention avoids all the drawbacks of the '864 patent by providing an elegantly simple apparatus that may be readily added to any paint container and retained therein, covered by a lid, for subsequent use.

SUMMARY OF THE INVENTION

The invention is directed to a brush support apparatus for use in a container and a method of controlling the depth bristles of the brush may be dipped into paint in the container, as the paint level falls in the container. The brush support apparatus includes a rotatable disk that is adapted to accommodate the bristles of a brush resting thereon. The disk is physically configured to have an annular, helical thread configuration that cooperates with a mating helical thread structure that is adapted for inclusion in the container. Rotation of the disk causes the disk to move to varying levels in the container from a top of the mating helical thread structure to a bottom of the mating thread structure adjacent the bottom of the container. The ability to move the brush support disk to varying levels in the container is highly useful in controlling paint level depth above the disk so as to ensure a consistent depth to which bristles of the brush may be dipped as paint level in the container falls in response to paint removed from the container as a consequence of repeated transport of paint on the brush bristles to a surface to be painted.

Therefore, a primary object of the invention is to provide a brush support apparatus that may be stored in a paint container or removed at will to be used in another paint container.

Another object of the invention resides in the provision of a movable brush bristle support disk that is adapted to accommodate the insertion of an external element that, when rotated, causes the disk to move to different levels in the container.

Yet another object of the invention is to provide a brush support apparatus for a container, wherein a thread portion of the apparatus is integrally formed on or into a wall of the container.

Still yet another object of the invention resides in the brush bristle support apparatus' unique capacities to remain within a paint container with a container lid in place, when the paint container and paint are in storage.

In the attainment of the foregoing objects the invention contemplates as falling within the purview of the claims a brush bristle support apparatus for use in a container. The apparatus includes a rotatable disk adapted to accommodate the bristles of a brush resting thereon. The disk has an annular, helical thread configuration that cooperates with a mating helical thread structure that is adapted for inclusion in the container. The disk has an annular thread configuration that includes a step that begins at an edge of the disk and extends radially toward the center of the disk, where the step height diminishes to zero, to thereby establish a helical incline plane that rises over 360 degrees from a base of the step to a top of the step. Rotation of the disk causes the disk to cooperate with the mating helical thread structure to move to varying levels in the container from near the top of the container to the bottom of the container, to thereby allow a container lid to be positioned between a top of the mating helical thread structure and a top of the container.

The invention further contemplates the inclusion of a method of controlling paint carried on the bristles of a paintbrush by continuously controlling a depth to which the brush bristles may be inserted into a paint container, as paint is continuously removed from the container by repeated insertions of the paintbrush into the paint. The method broadly involves the following steps:

providing a container that has a paintbrush bristle support apparatus that includes a rotatable disk adapted to accommodate bristles of a paintbrush in contact with the disk, the disk having an annular helical thread configuration that cooperates with a mating helical thread structure that is adapted for inclusion in the container.

rotating the disk, causing the disk to move to varying levels in in the container from a top of the mating helical thread structure to a bottom of the mating helical thread structure adjacent a bottom of the container, to thereby control the depth of the paint above the disk such that the depth of the paint does not exceed the length of the paintbrush bristles as paint level changes in response to the continuous removal of paint from the container.

BRIEF DESCRIPTION OF THE DRAWINGS

The description set forth above, as well as other objects, features and advantages of the present invention, will be more fully appreciated by referring to the detailed description and the drawings that follow. The description is the presently preferred, but nonetheless illustrative, embodiments in accordance with the present invention when taken in conjunction with the accompanying drawings.

DETAILED DESCRIPTION OF THE PREFERRED EMBODIMENT

Figure 1:
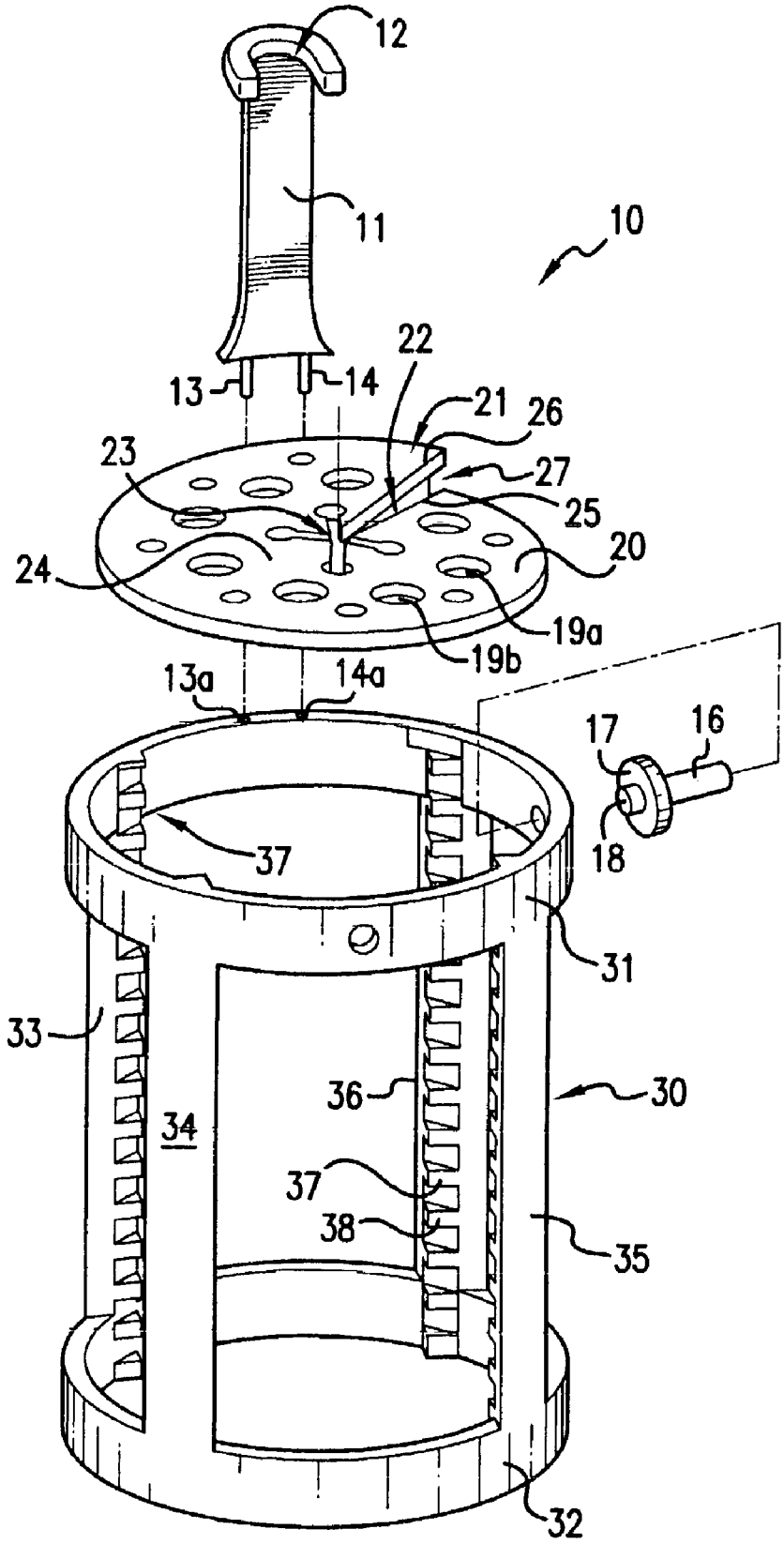
FIG. 1 is an exploded perspective of a preferred embodiment of the invention.
Figure 2:
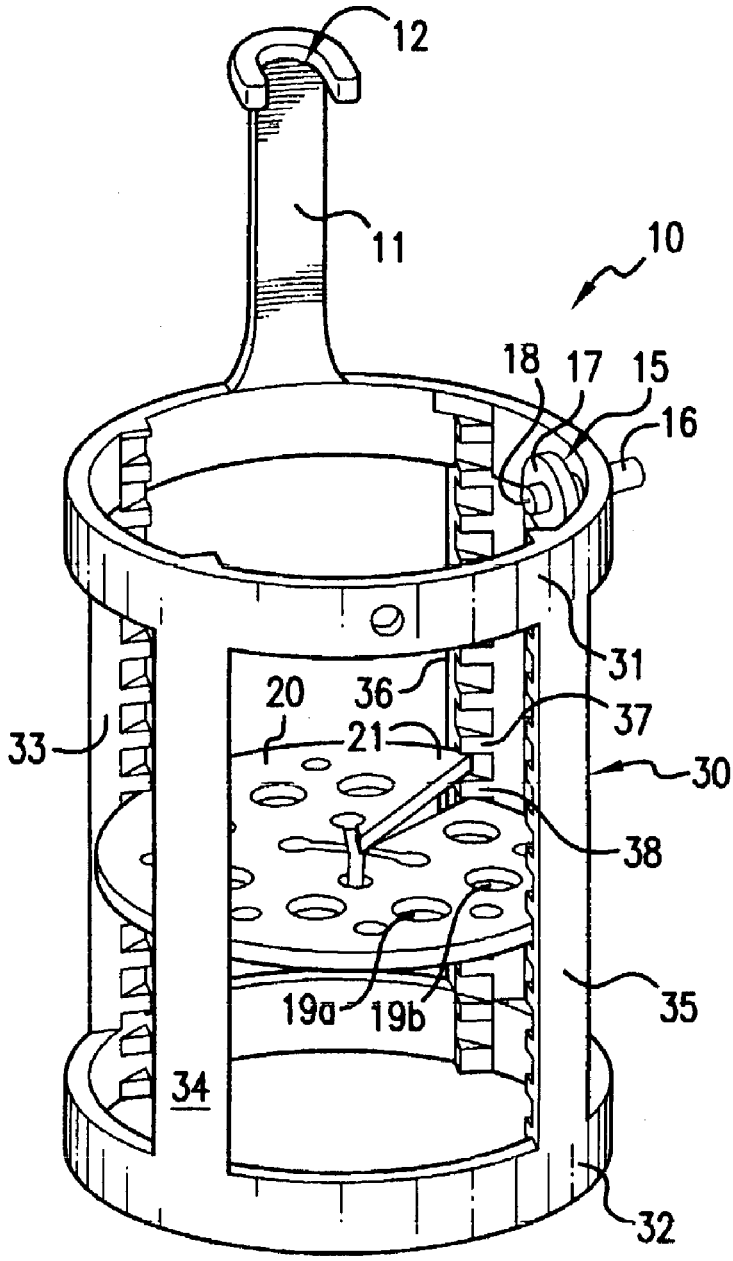
FIG. 2 is a perspective assembled view of the invention of FIG. 1.
Figure 3:
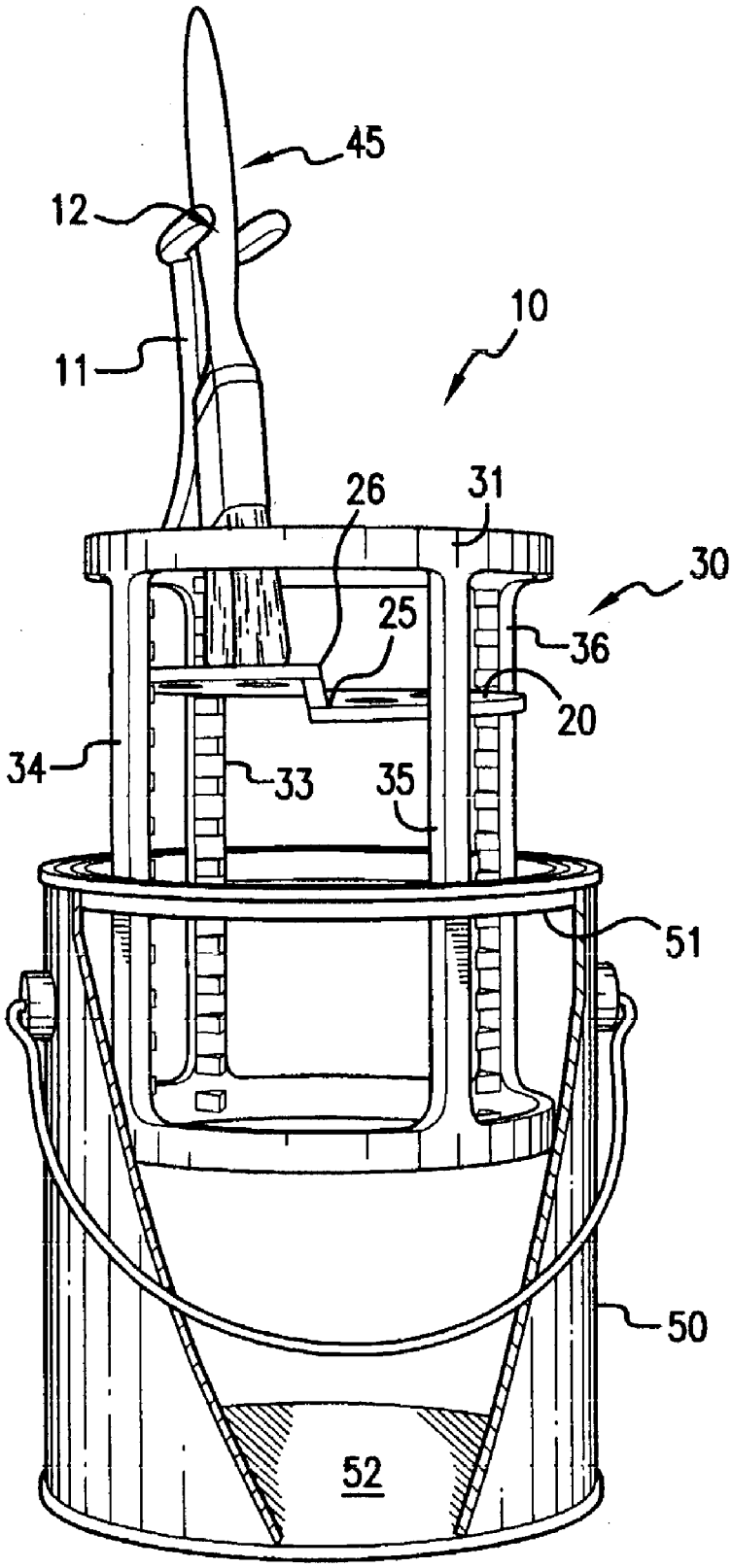
FIG. 3 is a perspective view of a preferred embodiment of the invention, shown partially assembled in a paint container with a paintbrush in place.

Reference is now made to FIGS. 1, 2 and 3 which, when taken together with the description that follows, will provide an explanation of the basic structure and function of a preferred embodiment of the invention. In each of these three figures there is shown a brush support apparatus 10 in various stages of assembly, prior to use.

The brush support apparatus 10 of FIGS. 1 and 2 is shown in FIG. 3 partially inserted in a paint container 50 with a brush 45 supported upon a rotatable disk 20.

With specific reference to FIG. 1, it will be observed that this illustration depicts an exploded perspective of the basic components involved in the practice of the instant invention. The brush support apparatus 10 includes a rotatable disk 20, adapted to accommodate a brush 45 (See FIG. 3) placed thereon. The disk 20 is provided with an annular thread configuration 21 that cooperates with a mating helical thread structure 30 that is adapted for inclusion in a paint container/can 50 (See FIG. 3).

The rotatable disk 20, with its annular thread configuration, includes a step 22 that begins at an outer edge of the disk 20 and extends radially toward a center 23 of the disk 20, where the step height diminishes to zero. Note the presence of a notch 27 located, as shown, near the outer end of the step 22. The just described step structure establishes a helical incline plane that rises over 360° from a base 25 of the step 22 to a top 26 of the step.

The disk 20 also includes a plurality of openings, two of which 19*a* and 19*b*, have been referenced. These openings allow paint to flow through them when the disk is being adjusted to different levels. The more openings there are the easier it will be to manually adjust the level of the disk 20 as will be described in the explanation of FIG. 7 herein after.

Positioned immediately beneath the rotatable disk 20 there is shown a mating helical thread structure 30 which, when fully inserted into the container 50, will extend from near a top 51 of the container 50 (See FIG. 3) to a bottom 52 of the container.

The mating helical thread structure may take an overall tubular form that includes an upper rim 31 and a lower rim 32 that are structurally joined by vertical struts 33, 34, 35 and 36, as shown in FIGS. 1, 2 and 3. Each of the vertical struts 33, 34, 35 and 36 include therein integrally formed, individual helical thread structures, such as thread elements 37, 38 (FIGS. 1 and 2). When the mating helical thread structure 30 is fully inserted into the container 50, it should be readily apparent that the mating helical thread structures contained in each of the vertical struts 33, 34, 35 and 36 will be located in the container 50 from near the top 51 of the container 50 to near its bottom 52.

Reference is now made specifically to FIG. 2, which depicts, in perspective view, an assembly of the preferred embodiment shown in FIG. 1. Here it will be noted that a removable paintbrush handle support component 11 with a "U" shaped yoke 12 and pins 13, 14 are shown inserted into pin openings 13*a*, 14*a* of FIG. 1. Note also that the rotatable brush support disk 20 is shown threaded down into the mating helical thread structure 30. In this figure the cooperation of the rotatable disk 20 with its annular helical thread configuration 21, with the step notch 27, allows the rotatable disk helical thread configuration to engage helical thread elements such as elements 37, 38 disposed on the vertical strut 36. The manner in which the rotatable disk can be rotated and caused to move to different levels in the paint container 50 will be readily apparent if attention is now directed to FIG. 7, which illustrates, in a perspective view, the preferred embodiment of the invention shown and described in FIGS. 1, 2 and 3. The rotatable disk 20 includes an "X" shaped opening 28 that is adapted to receive an elongated element, here shown as a conventional paint stirrer 60. In FIG. 7 the paint stirrer 60 is shown disposed at an angle as it enters the "X" shaped opening 28 in the rotatable disk 20. In actual use the paint stirrer 60 is moved to a more vertical position as is indicated by arrow 61. With paint stirrer 60 in a more upright position, fingers of a hand of a painter, not shown, may grip the paint stirrer 60 and cause the disk 20 to rotate clockwise or counter clockwise, as is indicated by arrows 62, 63. For purposes of explaining the physical cooperation of the paint stirrer 60 with the "X" shaped opening 28, the container paint can 50 is shown with no paint. It goes without saying that when the paint can 50 includes paint that fills it to a level above a surface of the rotatable disk 20, the "X" shaped opening will not be visible. This lack of visibility of the "X" shaped opening 28 is no problem to the painter, because the painter need only insert the paint stirrer 60 into the paint can 50 until an end of the stirrer comes in contact with a surface of the disk 20. Thereafter, a simple swiping motion of the stirrer 60 will bring the end of the stirrer into engagement with the "X" shaped opening 28, whereupon the stirrer 60 may then be rotated, causing the disk 20 to rotate and thereby moving the disk 20 to different levels in the paint can 50. A more detailed explanation of the benefits that derive from the ability to change the depth to which a paintbrush's bristles may be inserted into the paint of a paint can, will be more fully undertaken when FIGS. 5 and 6 are described in detail hereinafter.

Figure 2A:
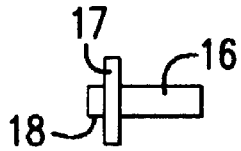
FIG. 2*a* is a perspective view of the detent element of FIG. 1 and FIG. 2.

Attention is now directed to FIG. 2, which illustrates a detent element 15, which is shown in detail in FIG. 2*a*. The detent element 15 includes a container-engaging protuberance 16 that may be inserted through an opening not shown in the upper rim 31 of the support apparatus 10. A plate 17 is integrally associated with the protuberance 16, and an easily grasped fingertip feature 18 of the detent element 15 is also shown. The purpose of the detent element 15, when it is in place after the mating helical thread structure is inserted into a paint can, is to allow the paint can to be manually lifted and tipped and paint poured into another container, insuring that the entire brush support apparatus 10 will not unexpectedly exit the paint can 50 during the paint transfer.

Figure 4A:
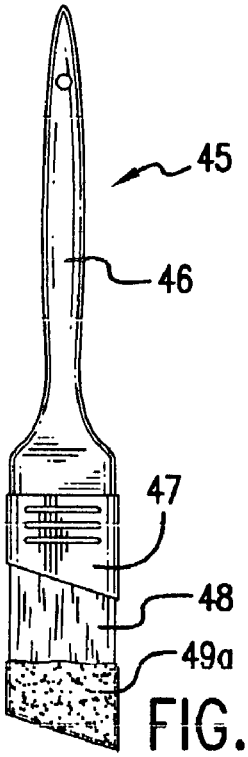
FIG. 4*a* is a perspective view of a paintbrush with a preferred amount of paint shown carried on bristles of the brush and FIG. 4*b* is a perspective view of a paintbrush that has been dipped deeply into paint and is covered with excess paint.
Figure 4B:
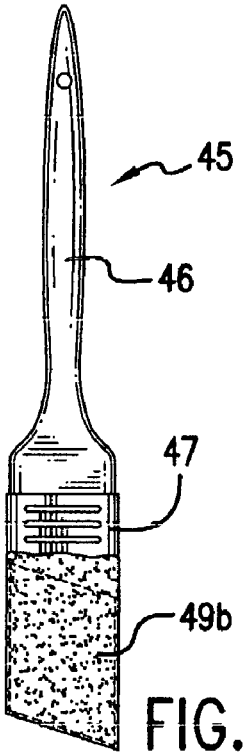

Turn now to FIGS. 4*a* and 4*b* that are perspective views of a paintbrush 45 that is one of the many conventional types of paintbrushes that may be employed in conjunction with the subject invention. In FIG. 4*a* it will be observed that the paintbrush 45 has an elongated handle 46 that includes at a lower end, a metal band 47 that is designed to grip both the elongated handle 46 and brush bristles 48. A lower end of the brush bristles 48 is shown covered with an ideal amount of paint 49*a*. It is commonly recognized that paintbrush bristles of a more effective design include individual bristles that are tapered from the region embraced by the metal band to the bristle ends. The tapered nature of the bristles aids in a wicking action that ensures optimal paint covering of the brush bristles, once the brush bristles have been dipped into paint to an ideal level for each brush type. The tapered nature of the brush bristles also affords the painter better control of paint distribution, especially when detailed edge work is involved. FIG. 4*b* illustrates a paintbrush of the same design and construction as that shown in FIG. 4*a*. However, in FIG. 4*b* the bristles 48 of the brush 45 are shown covered with an excess quantity of paint 49*b*. It may properly be asked, "Why is excess paint on a brush's bristles a bad thing?" It would seem a simple matter to scrape off the excess paint on the metal band 47 and the bristles 48, as mentioned earlier. Most painters are unaware that once the brush bristles 48 immediately adjacent the metal band are completely soaked with paint and this paint has wicked itself up into the bristles within the metal band, the brush will never, in subsequent paint uses, provide the original easy-to-apply feel of the brush when the brush was new. When the brush is of the expensive type, most painters are reluctant to buy a new brush and become resigned to the continuous degrading of the brush's paint handling and paint application performance. On the one hand, paintbrush manufacturers are benefited by improper paint bristle dipping. On the other hand, professional painters and a nearly countless number of home improvement types bear the burden of decreased brush performance and ultimately the added cost of purchasing new paintbrushes to replace their prematurely fouled paintbrushes. It is to this incipient and persistent excess paint problem that the subject invention provides an elegantly simple, yet profoundly beneficial solution, namely an apparatus and method to prevent excess paint on paintbrush bristle.

Figure 6A:
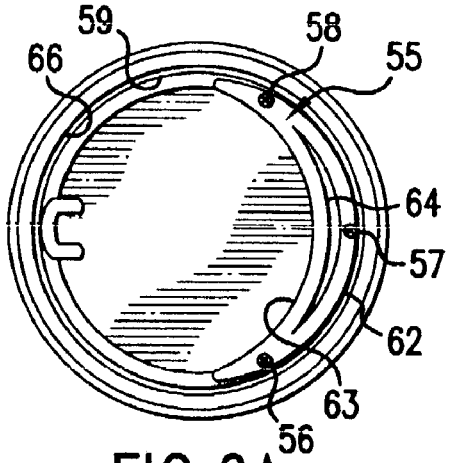
FIG. 6A is a top view of FIG. 6, absent the paintbrush taken along the line 6A—6A in FIG. 6.
Figure 5:
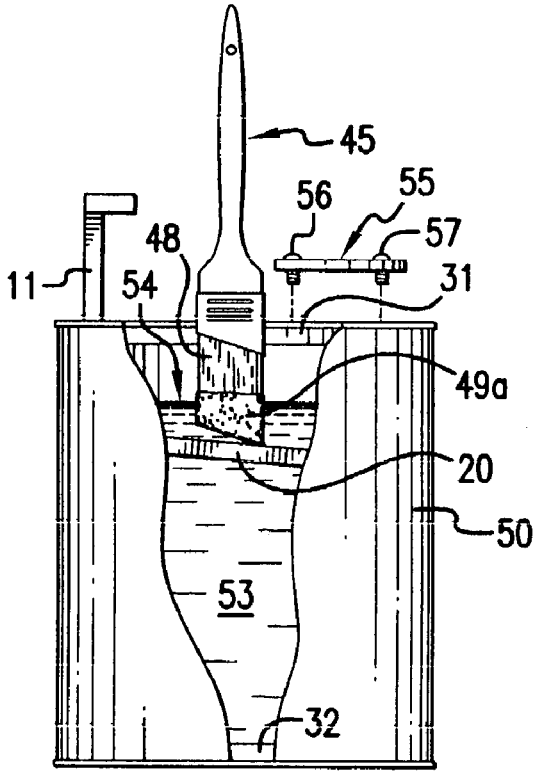
FIG. 5 shows, in a schematic manner, a nearly full paint container having a partial section that reveals the invention as well as a paintbrush wiper positioned above the container.
Figure 6:
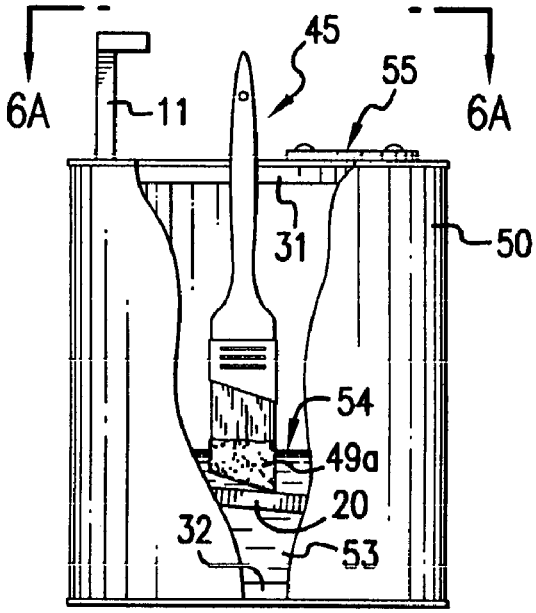
FIG. 6 shows the paint container as depicted in FIG. 5 with a paint level near the bottom of the container and the paintbrush wiper of FIG. 5 in place.
Figure 7:
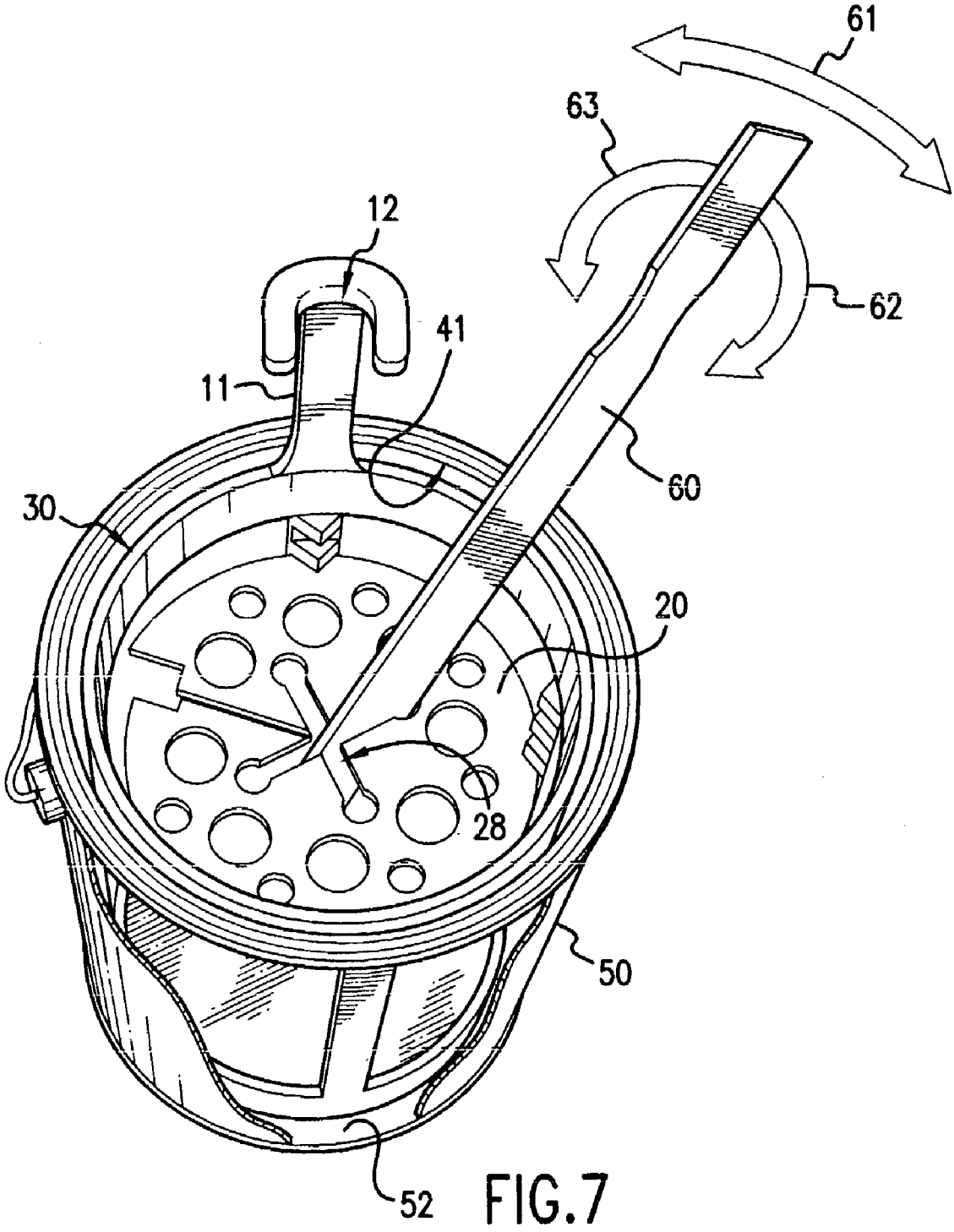
FIG. 7 is a perspective view of a paint container that includes a preferred embodiment of the invention in place in a paint container.

The utility of the instant invention will become readily manifest upon the study of the schematic illustrations of FIG. 5 and FIG. 6. In FIG. 5 a paintbrush 45 is shown, for purposes of explanation, in a nearly vertical position, much as would arise if the brush were being dipped into the surface 54 of paint 53 in the paint can 50. The rotatable disk 20 is shown in an adjusted position, such that the ends of brush bristles 48 abut the rotatable disk 20 and guarantee a flawless coating of the bristles 48 with paint to an exact depth determined by the level of the disk 20. FIG. 6 further illustrates the remarkable utility of the invention when, as a consequence of paint removal from the paint can 50, the surface of the paint 54 falls to a lower level in the paint can 50. Note once again that the incorporation of the invention in the paint can affords the same beneficial effect as was just described with respect to FIG. 5, namely complete control of the depth to which the bristles 48 may be dipped into the paint 53.

Returning now to FIG. 5 it will be noted that just above the paint can 50 there is shown a side view of a paintbrush wiper 55 positioned above the upper rim 31 of the mating helical thread structure 30 described earlier. Pins 56,57 are shown passing through the paintbrush wiper 55. Lower ends of the pins, not referenced, are adapted to engage openings (not shown) in the upper rim 31. FIG. 6A is a top view of FIG. 6 in which the paintbrush 45 of FIG. 6 has been removed. It will be observed that the paintbrush wiper 55 has an overall crescent shape appearance. The crescent shaped brush wiper 55 is provided with a convex curvature 62 that matches an external curvature 59 of the upper rim 31. The crescent shaped paintbrush bristle wiper 55 is provided with a concave curvature 63 that provides a brush bristle wiper surface. The crescent shaped wiper 55 includes a crescent shaped opening 64 that is coextensive with the crescent shaped wiper 55. The opening 64 provides a return flow path for paint from brush bristle-to-wiper-to-container. The wiper 55 is frictionally secured to upper rim 31 by means of the pins 56,57,58. The wiper 55 may be readily removed by placing a fingertip or any hooked shaped tool under the wiper 55 followed by pulling upward. Removal of the object support component 11,12 and wiper 55 will allow a lid to be placed on the container 50. The crescent shaped wiper 55 and the removable object support component 11,12 cooperate, when in place, with an inner edge 66 of the top of the container 50 to thereby prevent rotation of the mating helical thread structure 30 when the rotatable disk 20 is being rotated to adjust the level of the disk 20 in the container 50. It is to be noted that rotational movement of the mating helical thread structure 30 may only be a concern when the paint is of high viscosity which results in increased shear forces between the disk 20 and the teeth of the helical thread structure 30 which tend to induce a drag force on the helical thread structure 30.

Reference is again made to FIG. 7, which includes a preferred embodiment of the invention shown in place in a paint can 50. The description and explanation of FIG. 7 is a further elaboration of how, in a stunningly simple manner, rotatable disk 20 may be positioned at any level in the container 50, with minimal effort by a painter, therefore guaranteeing a maximum depth to which the bristles of a brush may be dipped into paint as the paint level changes. A conventional paint stirrer 60 is shown inserted into the "X" shaped opening 28. Imagine next the paint stirrer's elongated nature allows a lower end thereof (not referenced) to extend through and beneath the disk 20. When the stirrer 60 is moved toward a more vertical position, as indicated by direction arrows 61, and then rotated clockwise or counter clockwise (See arrows 62, 61) by fingers of the painter (not shown), the helical, threaded nature of the rotatable disk as it rotates causes it to engage threaded regions of the mating helical thread structure 31 in the can 50, which results in the translation of the disk 20 up and down within the container 50. The invention is not intended to be limited in any way by the configuration of the opening, here shown as having an "X" shape. As noted earlier paint, because of its inherently opaque nature, the presence of paint in a container will not afford the painter a direct view of the "X" shaped opening. The painter need only insert the paint stirrer into the paint and draw an end of the stirrer across the submerged surface of the rotatable disk until the painter manually senses that the end of the paint stirrer is engaging some edge of the "X" shaped opening 27 whereupon with a few simple twists of the stirrer 60 the stirrer will readily enter the "X" shape opening 27 and allow the painter to adjust the rotatable disk 20 to any desired level in the paint can.

Figure 8:
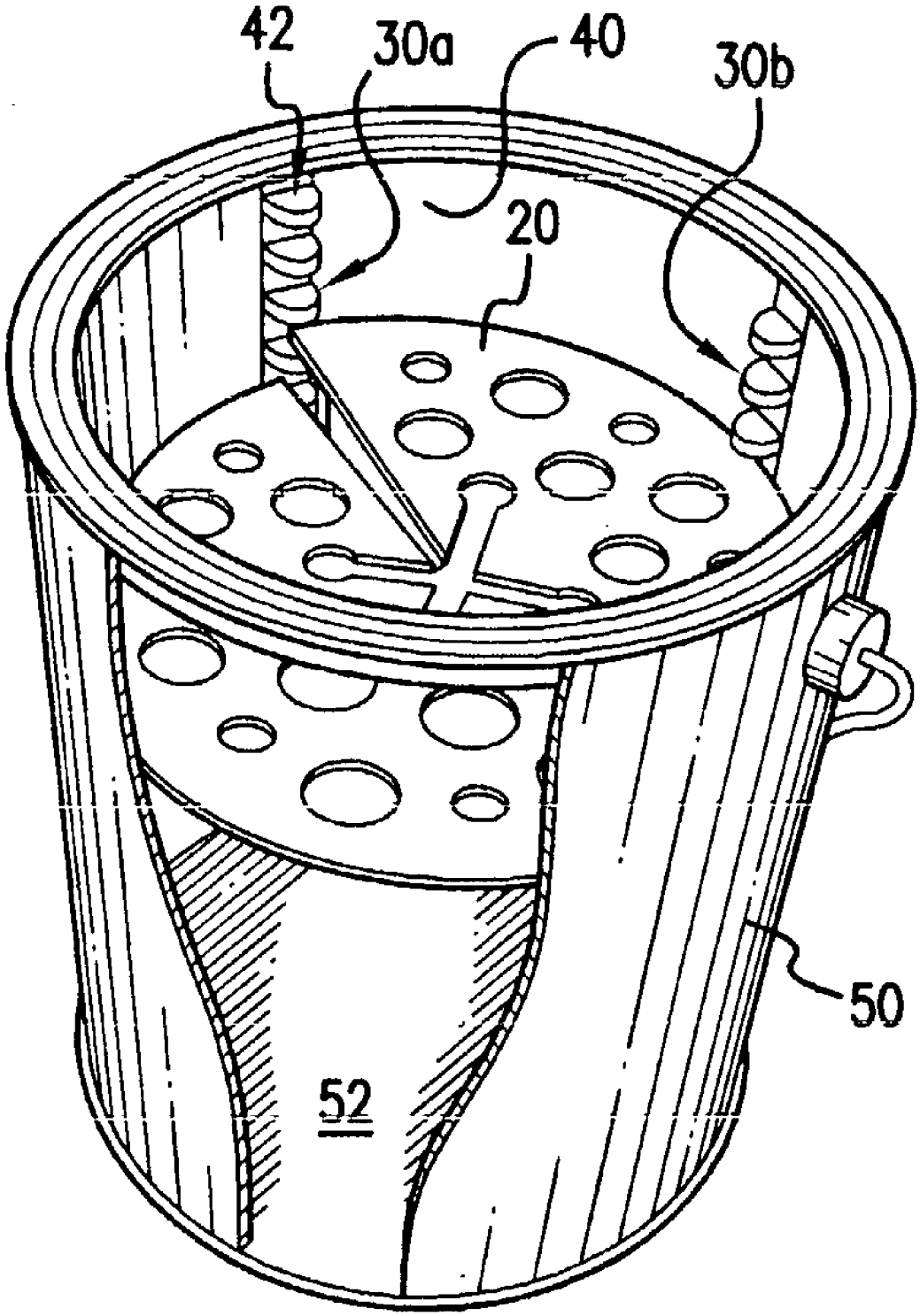
FIG. 8 is a perspective view of another embodiment of the invention in a paint container.
Figure 9:
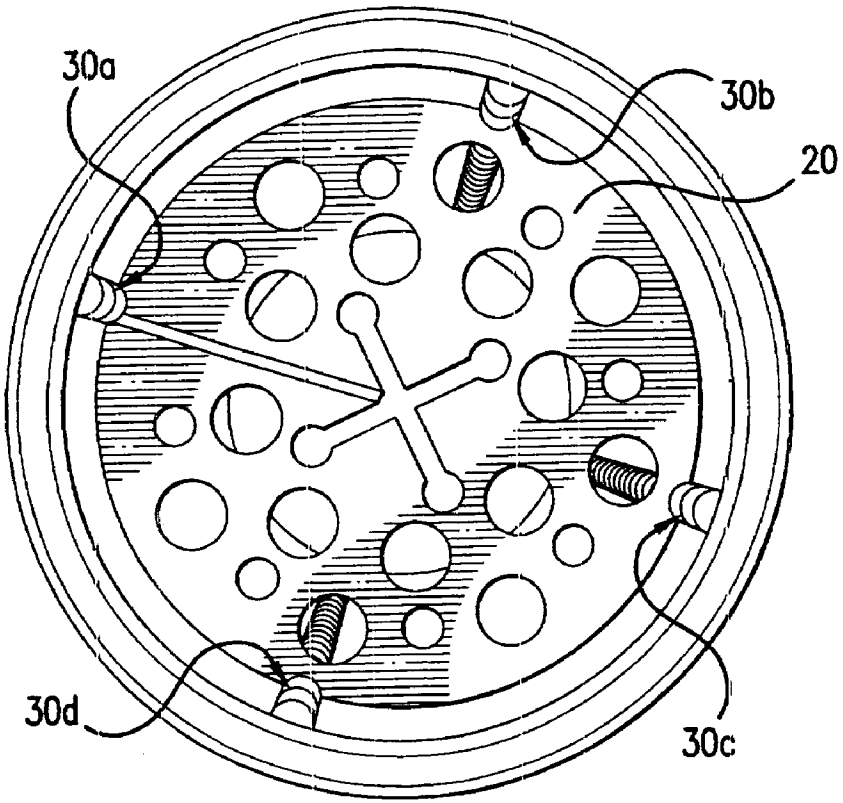
FIG. 9 is a top view of FIG. 8.

Reference is now made to FIGS. 7 and 8, which illustrate another embodiment of the invention. In the perspective view of FIG. 8 it will be noted that the mating helical thread structure that is adapted for inclusion in the paint can 50 is comprised of a plurality of helical threaded components, two of which, 30*a* and 30*b*, are readily discernable in FIG. 8. In practice three or more such thread components are either bonded to an inner surface 40 of the paint container 50 or alternatively formed on the inner surface 40 of the can 50. FIG. 9, is a top view of the container 50 of FIG. 8, reveals an embodiment of the invention that is provided with four helical thread components 30*a*, 30*b*, 30*c* and 30*d*

FIGS. 1 through 7 depicts various aspects of the detailed structure and function of the preferred embodiment of the invention. This preferred embodiment can be described as an after-market apparatus that fills a long standing, if not fully appreciated, need for paint depth control of paintbrush bristles in an open paint can.

Another embodiment of the invention shown in FIGS. 8 and 9 looks to providing existing paint container manufacturing enterprises with an exceedingly easy way to include the invention in paint cans prior to sale of the paint cans filled with paint.

Returning now to the preferred embodiment of the invention as shown in FIGS. 1 to 7, the manufacture of the mating helical thread structure 30 is easily accomplished when the mating helical thread structure 30 is comprised of plastic and an injection molding process is employed. The manufacture of the rotatable disk 20 could also be formed by an injection molding process. It is to be understood that the somewhat bulky nature of the helical thread structure depicted in the invention embodiments shown and described herein are intended only to be exemplary of such a helical thread structure. The invention contemplates as falling within the purview of the attached claims materials, such as metal or plastic, that may be formed or stamped from sheets of material and then shaped into a cylindrical form. In a like manner the rotatable disk may be created by a two-procedure stamping process where, in a first procedure, the circular openings such as 19*a* and 19*b* and the notch 27 are created in a metal sheet and, in a second procedure, the step 22 is created.

In a similar way, the walls of a container may be formed in a manner that will embody the invention as it is depicted in FIGS. 8 and 9. Should the can 50 be injection molded, the helical thread structure would be formed by design into the inner wall of the container. Where the container is made of sheet metal, the inner wall is conventionally fashioned from a single sheet of metal, which is then formed into a cylinder to which a container bottom and a ring shaped lid element are secured to produce the finished container. This process may be easily modified to include an embossing step that would emboss into the sheet metal of the inner container wall the required helical thread structure essential to the practice of the instant invention. In the just described embodiment of the invention, the rotatable disk 20 would be provided to a purchaser of the paint containing can at the time of sale.

Figure 10:
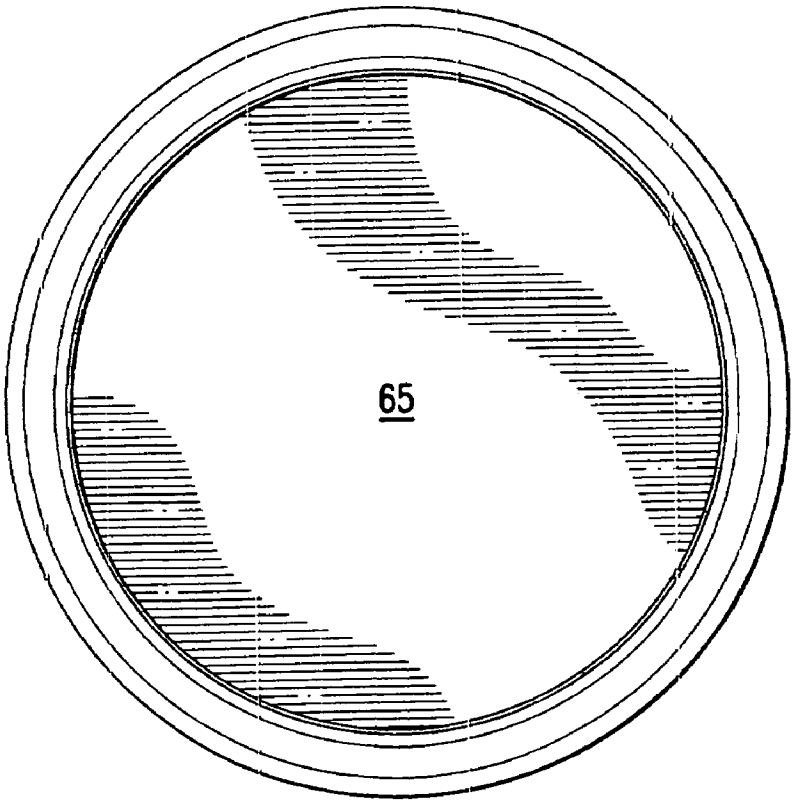
FIG. 10 is a top view of FIG. 7 with a brush handle support component removed and a paint container lid in place or alternatively the embodiment of the invention shown in FIGS. 8 and 9 with a paint container lid in place.

Last but not least the subject invention provides another major advantage to individuals employing the invention in either embodiment of the invention. The advantage resides in the ability to replace a paint can lid 65, FIG. 10 back onto the paint container 50 even when the rotatable disk 20 and the mating helical thread structure 30 remain in the can. The ability to reseal the paint container with a lid is possible because of the space (not referenced) provided between the top of the mating helical thread structure 30 and the top of the can. In the preferred embodiment this would simply entail the removal of the removable object support component 11 and the placement of a lid 65, FIG. 10 on the paint container. In order that this highly desirable storage feature is included in both embodiments, the mating helical thread structure will extend from near the top of the container 50 as indicated by arrow 41, FIG. 7 and arrow 42 in FIG. 8, to the container bottom 52.

The invention further provides in addition to apparatuses to practice the invention, a method of controlling paint carried on the bristles of a paintbrush by continuously controlling a depth to which the brush bristles may be inserted into paint in a container as paint is continuously removed from the container by repeated insertions of the paintbrush into the paint, the method comprising the following steps:

providing a container that has a paintbrush bristle support apparatus that includes a rotatable disk adapted to accommodate bristles of a paintbrush in contact with the disk, the disk having an annular helical thread configuration that cooperates with a mating helical thread structure that is adapted for inclusion in the container.

rotating the disk to cause the disk to move to varying levels in in the container from a top of the mating helical thread structure to a bottom of the mating helical thread structure adjacent a bottom of the container, to thereby control the depth of the paint above the disk such that the depth of the paint does not exceed the length of the paintbrush bristles as paint level changes in response to the continuous removal of paint from the container;

inserting in the container a removable paintbrush bristle support apparatus that includes the rotatable disk adapted to accommodate bristles of a paintbrush in contact with the disk, the disk having an annular helical thread configuration that cooperates with a mating helical thread structure of the removable support apparatus;

providing the rotatable disk with a step that begins at an edge of the disk and extends radially toward the center of the disk where the step height diminishes to zero to thereby establish a helical inclined plane that raises over 360 degrees from a base of the step to a top of the step;

providing an opening in the rotatable disk adapted to receive an elongated element;

inserting the elongated element into the opening of the disk; and rotating the element to cause the disk to rotate and thereby vary the disk level in the container.

Though the invention has been described with respect to a pair of specific embodiments, many variations and modifications will immediately become apparent to those skilled in the art. It is therefore the intention that the appended claims be interpreted as broadly as possible in view of the prior art to include such variations and modifications.

What is claimed is:

1. A paintbrush support apparatus adapted to use in a paint container, the paintbrush support apparatus comprising:

a rotatable disk adapted to accommodate paintbrush placed thereon, the rotatable disk having a raised portion that begins at an edge of the disk and extends radially toward the center of the disk where the raised portion diminishes in height to zero to thereby establish a helical incline plane that rises over 360 degrees from a base of the raised portion to a top of the raised portion; the disk having at its edge an annular helical thread configuration that cooperates with a mating helical thread structure positioned adjacent to an inner surface of a paint container;

rotation of the disk causes the disk to move to varying levels from a top of the mating helical thread structure to a bottom of the mating helical thread structure;

the mating helical thread structure is provided with a paintbrush support component removably secured thereto, the paintbrush support component is configured to accommodate a portion of a paintbrush that is supported by the disk and extends above the top of the mating helical thread structure, the paintbrush support apparatus is provided with at least two openings, at least one of the openings adapted to receive an elongated element such that with the element vertically positioned in the opening, whereby rotation of the element causes the disk to rotate and thereby vary the disk level from a top of the mating helical thread structure to a bottom of the mating helical thread structure;

the paintbrush support apparatus further includes a crescent shaped brush bristle wiper that is adapted to be securely attached to an upper rim of the mating helical thread structure such that the convex curvature of the crescent shaped brush bristle wiper matches an external curvature of the upper rim, the crescent shaped bristle wiper having a concave curvature that provides a brush bristle wiper surface.

2. The paintbrush support apparatus of claim 1 wherein the crescent shaped wiper includes there through a crescent shaped opening that is coextensive with the crescent shaped wiper, the crescent shaped wiper and the removable object support component adapted to cooperate when in place with an inner edge of the top of a container to prevent rotation of the mating helical thread structure when the rotatable disk is being rotated to adjust the level of the disk.

3. The paintbrush support apparatus of claim 2 wherein the brush bristle wiper having bristles and a handle, the handle cooperating with the paint support component when the paintbrush is placed on the disk between uses.

4. The paintbrush support apparatus of claim 1 wherein the mating helical thread structure is tubular in nature.

5. The paintbrush support apparatus of claim 4 wherein at least some regions of the inner surface of the tubular helical thread structure are provided with the mating helical threads.

6. The paintbrush support apparatus of claim 5 wherein the tubular mating helical structure has openings between the threaded regions.

7. The paintbrush support apparatus of claim 1 wherein the mating helical thread structure is adapted to be readily removed from a paint container.

8. The paintbrush support apparatus of claim 1 when in use with a container wherein the mating helical structure extends from near a top of the container to the bottom of the container, thereby allowing a container lid to be positioned adjacent to the top of the container and the mating helical thread structure.

9. A method of controlling paint carried on the bristles of a paintbrush by continuously controlling a depth to which the brush bristles may be inserted into paint in a container as paint is continuously removed from the container by repeated insertions of the paintbrush into the paint, the method comprising the following steps:

rotating a disk having an annular helical thread configuration that cooperates with a mating helical thread structure to cause the disk to move to varying levels in a container from a top of the mating helical thread structure to a bottom of the mating helical thread structure adjacent a bottom of the container to thereby control the depth of the paint above the disk such that the depth of the paint does not exceed the length of the paintbrush bristles as paint level changes in response to the continuous removal of paint from the container, providing the rotatable disk with a raised portion that begins at an edge of the disk and extends radially toward the center of the disk where the raised portion diminishes in height to zero to thereby establish a helical incline plane that rises over 360 degrees from a base of the raised portion to a top of the raised portion.

10. The method of claim 9 that further includes the following steps:

providing an opening in the rotatable disk adapted to receive an elongated element, and inserting the elongated element into the opening of the disk.

11. The method of claim 9 that further includes the following step:

rotating the element to cause the disk to rotate and thereby vary the disk level in the container.

* * * * *